US010053747B2

(12) United States Patent
Matsumoto

(10) Patent No.: US 10,053,747 B2
(45) Date of Patent: Aug. 21, 2018

(54) STEEL PART AND METHOD OF MANUFACTURING THE SAME

(71) Applicant: HONDA MOTOR CO., LTD., Tokyo (JP)

(72) Inventor: Kenji Matsumoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 236 days.

(21) Appl. No.: 15/124,453

(22) PCT Filed: Mar. 11, 2015

(86) PCT No.: PCT/JP2015/057131
§ 371 (c)(1),
(2) Date: Sep. 8, 2016

(87) PCT Pub. No.: WO2015/137388
PCT Pub. Date: Sep. 17, 2015

(65) Prior Publication Data

US 2017/0016083 A1 Jan. 19, 2017

(30) Foreign Application Priority Data

Mar. 11, 2014 (JP) ..... 2014-047388

(51) Int. Cl.
*C22C 30/00* (2006.01)
*C21D 9/32* (2006.01)
(Continued)

(52) U.S. Cl.
CPC ..... *C21D 9/32* (2013.01); *C21D 1/06* (2013.01); *C21D 1/785* (2013.01); *C21D 7/06* (2013.01); *C23C 8/32* (2013.01); *C23C 8/80* (2013.01)

(58) Field of Classification Search
CPC . C21D 9/32; C21D 1/785; C21D 1/06; C21D 7/06; C23C 8/80; C23C 8/32
(Continued)

(56) References Cited

U.S. PATENT DOCUMENTS 6,038,900 A 3/2000 Miyasaka
8,286,455 B2 10/2012 Fujii et al.
(Continued)

FOREIGN PATENT DOCUMENTS

CN 1905986 A 1/2007
CN 102812148 A 12/2012
(Continued)

OTHER PUBLICATIONS

International Search Report dated Jun. 16, 2015, issued in counterpart International Application No. PCT/JP2015/057131 (2 pages).

*Primary Examiner* — Haytham Soliman
(74) *Attorney, Agent, or Firm* — Westerman, Hattori, Daniels & Adrian, LLP

(57) ABSTRACT

A surface of a steel material cut to a desired shape and carbonitrided is heated by excitation and thereafter repeatedly heated/cooled a predetermined number of times, such that an ultrafine crystal layer is formed immediately under the surface of the steel material and at least a predetermined number of cracks are formed under the formed ultrafine crystal layer, thereby enabling to increase toughness of the surface or immediately thereunder and enhance tenacity and inhibiting growth of cracks.

4 Claims, 4 Drawing Sheets

(51) Int. Cl.

| | |
|---|---|
| ***C21D 7/06*** | (2006.01) |
| ***C23C 8/32*** | (2006.01) |
| ***C21D 1/06*** | (2006.01) |
| ***C21D 1/78*** | (2006.01) |
| ***C23C 8/80*** | (2006.01) |

(58) Field of Classification Search
USPC ..... 148/219
See application file for complete search history.

(56) References Cited

U.S. PATENT DOCUMENTS

| | | | | |
|---|---|---|---|---|
| 2006/0222883 | A1* | 10/2006 | Kaku | B24B 39/006 428/687 |
| 2009/0017949 | A1 | 1/2009 | Sato et al. | |
| 2010/0151270 | A1 | 6/2010 | Umemoto et al. | |
| 2013/0042992 | A1 | 2/2013 | Hiraoka et al. | |

FOREIGN PATENT DOCUMENTS

| | | | |
|---|---|---|---|
| JP | 11-347944 | A | 12/1999 |
| JP | 2004-339575 | A | 12/2004 |
| JP | 2007-297651 | A | 11/2007 |
| JP | 2008-260994 | A | 10/2008 |
| JP | 2009-14167 | A | 1/2009 |
| JP | 2009-114480 | A | 5/2009 |
| WO | 2007/102280 | A1 | 9/2007 |

* cited by examiner

SHOT BLASTING + COOLING

MECHANICAL RUBBING + COOLING

STEEL PART AND METHOD OF MANUFACTURING THE SAME

TECHNICAL FIELD

This invention relates to a steel part and a method of manufacturing the same.

BACKGROUND ART

As steel parts and methods for their manufacture are known those described in Patent Documents 1 and 2 listed below. The technology set out in Patent Document 1 is comprised so as to place a steel part in a sealed container charged with hydrocarbon gas, heat all but corner portions, and conduct ambient heat to raise the corner portions to a temperature lower than a surrounding flat portion, thereby inhibiting precipitation of cementite at the corner portions and achieving manufacture of a steel part excellent in toughness.

The technology set out in Patent Document 2 comprises charging mixed gas of hydrogen and nitrogen into a chamber accommodating a work to perform atmosphere replacement, lowering dew point to minus 50° C. or below, and thereafter initiating carburization by supplying a mixed gas of acetylene and nitrogen and thus manufacturing an unevenness-free carburized product incurring no hindrance of carburization by oxide film.

PRIOR ART REFERENCES

Patent Documents

Patent Document 1: Japanese Unexamined Patent Publication No. 2009-114480

Patent Document 2: Japanese Unexamined Patent Publication No. 2008-260994

SUMMARY OF INVENTION

Problems to be Solved by the Invention

In the technologies described in Patent Documents 1 and 2, carbonitriding is performed that uniformly increases hardness not only of the interior but also of the surface and its vicinity, so that toughness declines and any crack once formed tends to grow large. As a result, a problem arises that during sliding with another steel part, exfoliation at and near the surface and occurrence of large-grain wear debris are likely to arise, thereby disadvantageously degrading performance and durability of the steel part.

Therefore, the object of this invention is overcome the aforesaid problem by providing a steel part, and a method of manufacturing the same, that owing to enhanced toughness at and near the surface is unlikely to experience exfoliation or occurrence of large-grain wear debris when sliding with another steel part.

Means for Solving the Problems

In order to achieve the object, claim 1 is configured to have a steel part, comprising: a steel material cut to a desired shape and carbonitrided, whose surface is then repeatedly heated by excitation and cooled a predetermined number of times, such that an ultrafine crystal layer is formed immediately under the surface of the steel material and at least a predetermined number of cracks are formed under the formed ultrafine crystal layer.

Method according to claim 2 is configured to have a method for manufacturing a steel part from a steel material, comprising: a cutting step to cut the steel material to machine the material to a desired shape (S10); a carbonitriding step to carbonitride the cut and machined steel material (S14); and a crack forming step to excite and heat a surface of the carbonitrided steel material and thereafter cools, and repeat the heating and cooling a predetermined number of times (Cref), thereby forming an ultrafine crystal layer immediately under the surface of the steel material, and forming at least a predetermined number of cracks under the formed ultrafine crystal layer.

In the method according to claim 3, it is configured such that the crack forming step includes: a step to mechanically rub the surface of the steel material to heat and then cool the heated surface of the steel material.

In the method according to claim 4, it is configured such that the crack forming step includes: a step to bring particles or fluid into collision with the surface of the steel material to heat and then cool the heated surface of the steel material.

Effects of the Invention

In the steel part according to claim 1, it is configured such that as surface of a steel material cut to a desired shape and carbonitrided is heated by excitation and thereafter repeatedly heated/cooled a predetermined number of times, such that an ultrafine crystal layer is formed immediately under the surface of the steel material and at least a predetermined number of cracks are formed under the formed ultrafine crystal layer (S10 to S24), by which configuration toughness of the surface or immediately thereunder can be increased, thereby enhancing tenacity and inhibiting growth of cracks. Therefore, at the time of sliding with another steel part during use, exfoliation and generation of large-grain wear debris can be inhibited by discharging wear debris as fine grain abrasion powder, thereby enabling enhanced performance and durability of the steel part.

In other words, by repeating the heating-cooling process the predetermined number of times so as to form the ultrafine crystal layer immediately under the surface of the steel material and form the cracks in at least the predetermined number thereunder, it is possible to relieve solely residual stress immediately under the surface without lowering residual stress of the entire steel part, whereby toughness of the surface can be increased and tenacity improved.

As a result, exfoliation and occurrence of large grain wear debris immediately under the surface during sliding with another steel part can be inhibited to realize improved performance and durability of the steel part.

It should be noted that in the specification the "ultrafine crystal layer" means a layer that has crystal grains whose grain diameter is e.g. several nm to 1 μm.

In a method for manufacturing a steel part from a steel material according to claim 2, it is configured to have a cutting step to cut the steel material to machine it to a desired shape, a carbonitriding step to carbonitride the cut and machinse steel material, and a crack forming step to excite and heat a surface of the carbonitrided steel material and thereafter repeatedly performing heating/cooling that cools a predetermined number of times, thereby forming an ultrafine crystal layer immediately under the surface of the steel material, and forming at least a predetermined number of cracks under the formed ultrafine crystal layer, by which configuration, as stated above, toughness of the surface or immediately thereunder can be increased, thereby enhancing tenacity and inhibiting growth of cracks. Therefore, at the time of sliding with another steel part during use, exfoliation and generation of large-grain wear debris can be inhibited by discharging wear debris as fine grain abrasion powder, thereby enabling enhanced performance and durability of the manufactured steel part.

In other words, by repeating the heating-cooling process the predetermined number of times so as to form the ultrafine crystal layer immediately under the surface of the steel material and form the cracks in at least the predetermined number thereunder, it is possible to relieve solely residual stress immediately under the surface without lowering residual stress of the entire steel part, whereby toughness of the surface can be increased and tenacity improved.

As a result, exfoliation and occurrence of large grain wear debris immediately under the surface during sliding with another steel part can be inhibited to realize improved performance and durability of the manufactured steel part.

In the method according to claim 3, since the crack forming step is configured to include a step to mechanically rub the surface of the steel material to heat and then cool the heated surface of the steel material, there can be obtained, in addition to the effects mentioned above, it becomes easy to perform the steel material surface heating by excitation.

In the method according to claim 4, since the crack forming step is configured to include a step to bring particles or fluid into collision with the steel material surface to heat and then cool the heated surface of the steel material, there can be obtained, in addition to the effects mentioned above, it becomes easy to perform the steel material surface heating by excitation.

DESCRIPTION OF EMBODIMENT

An embodiment for implementing the steel part and method of manufacturing the same according to this invention is explained with reference to the attached drawings in the following.

Embodiment

Figure 1:
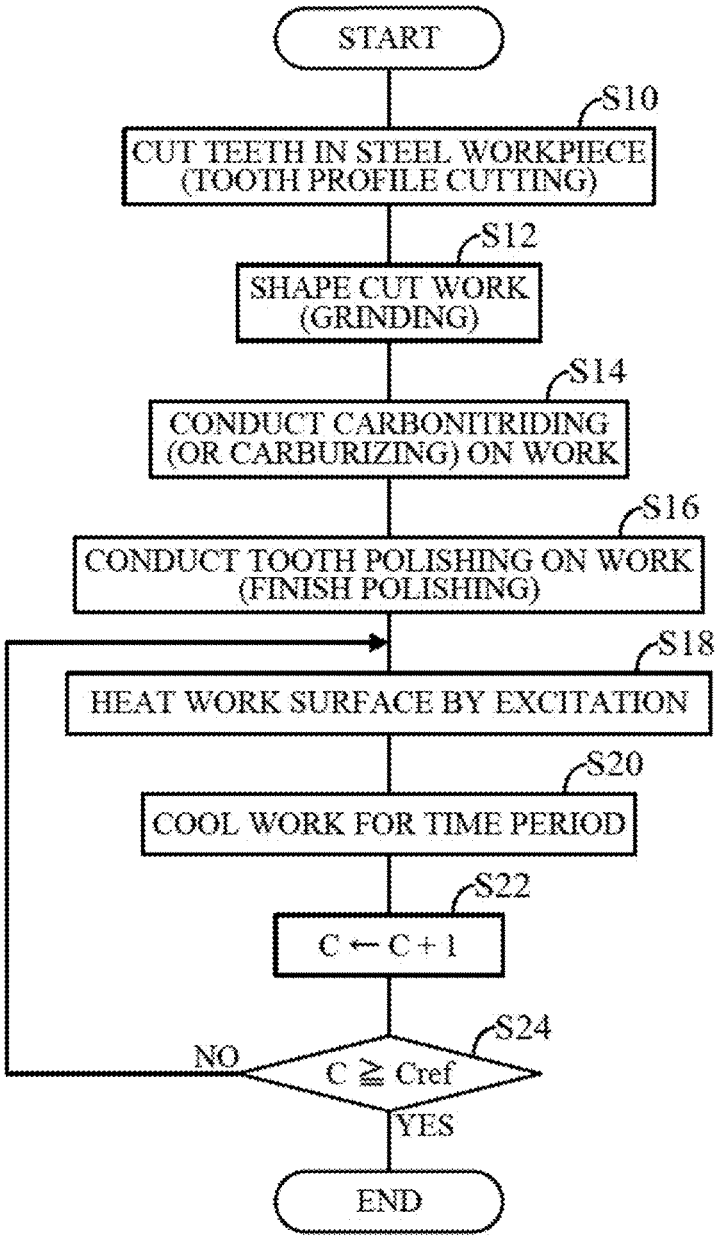
FIG. 1 is a process diagram showing a steel part manufacturing method according to an embodiment of this invention.
Figure 2:
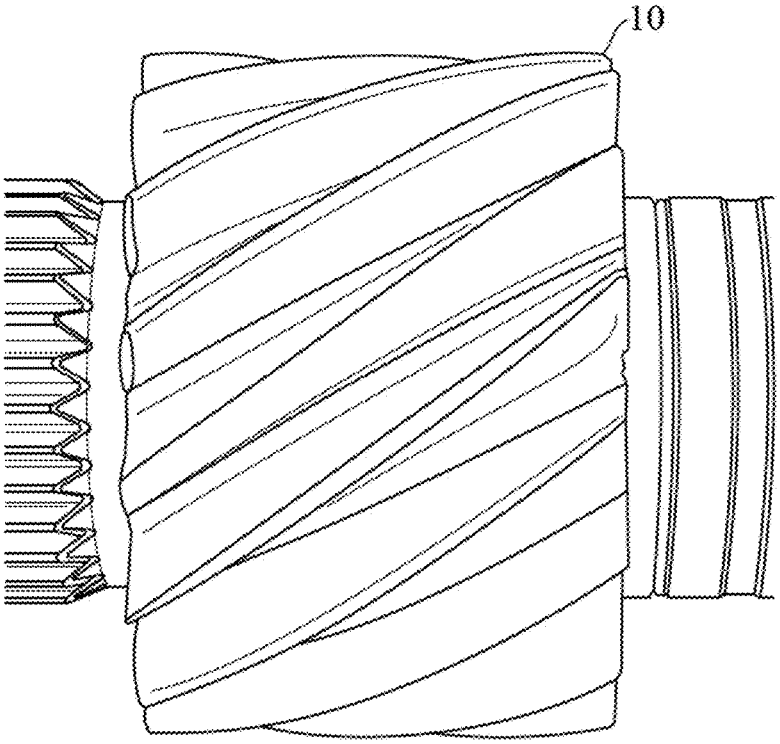
FIG. 2 is a front view showing a vehicle automatic transmission final gear that represents an example of a steel part manufactured in accordance with the process diagram shown in FIG. 1.

FIG. 1 is a diagram of a process for implementing a steel part manufacturing method according to an embodiment of this invention, and FIG. 2 is a front view showing a vehicle automatic transmission final gear representing an example of a steel part manufactured in accordance with the process diagram shown in FIG. 1.

Referring to FIG. 1 to first explain a method of manufacturing a steel part according to this embodiment, in S10 teeth are cut in the periphery of a cylindrical steel workpiece using a machine tool (tooth profile cutting) to machine to a desired shape close to a finished product as shown in FIG. 2 (S: processing step). In the following, a semi-finished product in the course of the individual processing steps up to completion of the finished product is called a "work."

As pointed out earlier, the steel part is exemplified by a vehicle automatic transmission final gear (hereinafter called "gear") 10 such as shown in FIG. 2. The gear 10 transmits shifted driving force by meshing with another gear of similar shape while contacting tooth surfaces. The tooth surface of the gear 10 is formed to be a curved surface because its profile is constituted as an involute curve or the like.

Next, in S12, the work (machined steel material) is shaped (ground). Specifically, the tooth profile of the cut work is finish-ground using a shaping cutter.

Next, in S14, carbonitriding (or carburizing) is conducted on the work by a known method. This processing uniformly establishes predetermined increased hardness of the work extending from its surface or immediately thereunder into the interior.

Then, in S16, surface bumps and pits of the carbonitrided work are reduced by tooth polishing (finish polishing) or similar. This step can be omitted.

Next, in S18, the finish-polished work surface is heated by excitation. This heating is performed by mechanically rubbing or shot blasting grains (beads) onto the work surface, thereby raising the work surface temperature to between around 150° C. and 200° C.

The mechanical rubbing is performed by agitating a jig pressed onto the work surface at a suitable pressure. The shot blasting is performed by jetting hard silicon or ceramic grains, or oil, water or the like (a fluid) onto the work surface for a suitable length of time. Instead of shot blasting, it is alternatively possible to use shot peening (using metal particles, oil, ultrasonic waves, or a laser beam, for example), or to perform thermal spraying.

Next, in S20, the heated work is contacted with air, water or oil to be rapidly cooled. The cooling is performed by bringing the work into contact with, for instance, air for a suitable time period.

Following this, in S22, the value of a counter C is incremented by 1, whereafter, in S24, it is determined whether the value of the counter C is equal to or greater than Cref (predetermined value; e.g., 10).

When the result in S24 is NO, the program returns to S18, and when YES, which means that the heating-cooling processing was found to have been repeated a predetermined number of times, the operation is terminated. As the processing of S18 is similar to the finish-polishing of S16, it is possible to establish processing conditions in S16 so as to obtain an effect similar to that of the S18 processing.

Alternatively, finish-polishing and other processing can be suitably added after the processing of S24. This final-polishing is defined to include, among others, mechanical polishing, chemical polishing and electrolytic polishing. Another option is to apply a coating such as of DLC (Diamond Like Carbon) or molybdenum disulfide to the surface after the operation at S24.

Figure 3:
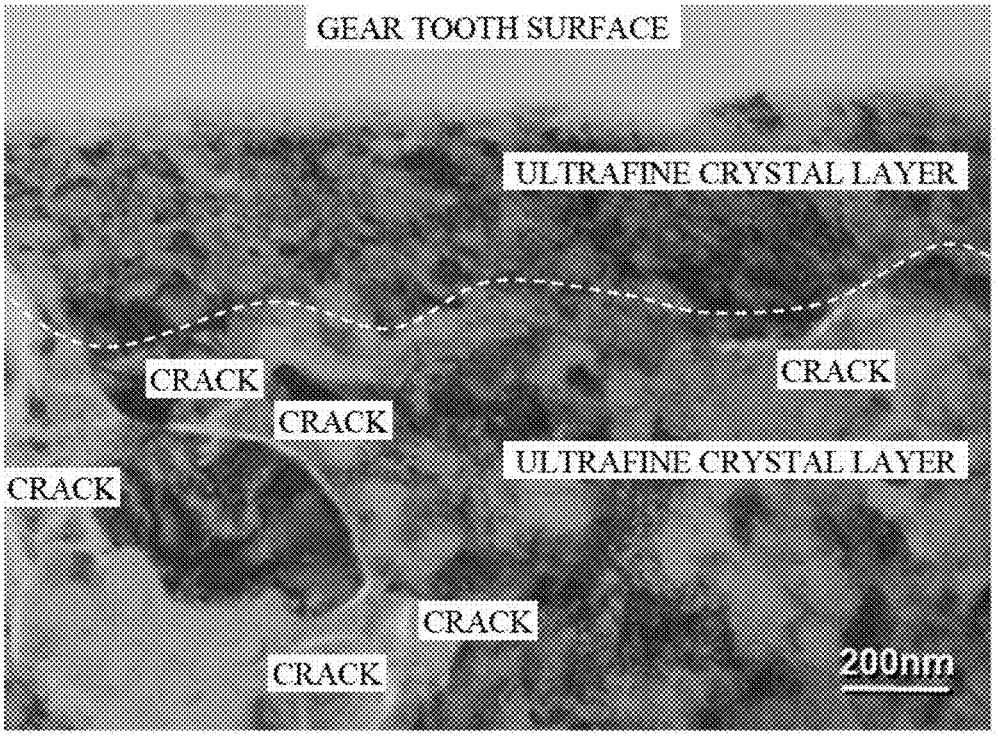
FIG. 3 is a cross-sectional TEM (Transmission Electron Microscope) image (photograph) of metallographic structure immediately under a surface of a gear manufactured in accordance with the process diagram shown in FIG. 1.

FIG. 3 is a cross-sectional TEM image (photograph) of metallographic structure immediately under a surface of a gear 10 manufactured in accordance with the process diagram shown in FIG. 1.

When the processing of S10 to S24 is carried out, an ultrafine crystal layer is, as illustrated, formed immediately under the surface of the work (steel material; gear 10), more exactly in a predetermined region between at least 100 nm below the surface and up to 500 nm from there, and cracks are formed in a predetermined number or greater in a fine crystal layer (ordinary crystal layer) under the formed ultrafine crystal layer (in other words, cracks do not readily form in the crystal region formed by the carbonitriding).

To be more specific, the ultrafine crystal layer is formed to a depth of about 400 nm below the surface, and at least a predetermined number of cracks are formed in the fine crystal layer under it. The predetermined number is preferably defined as a number that does not lead to cracks connecting with each other, such as a number between $1/\mu^2$ and $100/\mu^2$. In the case shown in FIG. 3, it is about $2/1\mu^2$.

Figure 4:
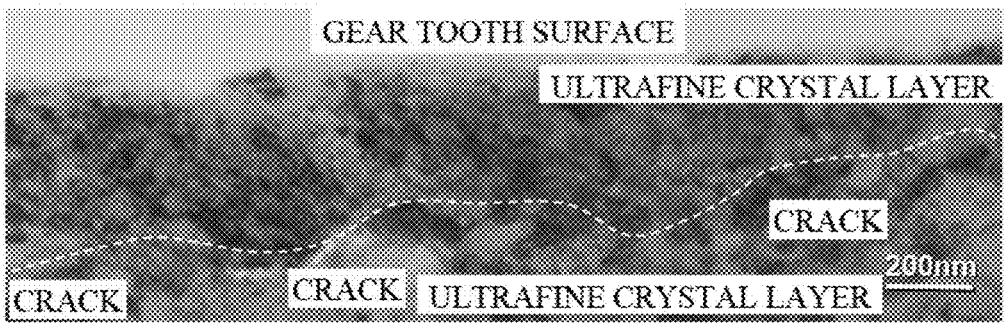
FIG. 4 is also a cross-sectional TEM image (photograph) of metallographic structure immediately under as surface of a gear manufactured in accordance with the process diagram shown in FIG. 1.

FIG. 4 also shows a cross-sectional TEM image (photograph) of metallographic structure immediately under a surface of a gear 10 manufactured in accordance with the process diagram shown in FIG. 1. While the example shown in FIG. 4 is a case in which the surface of the work is heated by mechanically rubbing the surface of the work, the example shown in FIG. 3 is a case in which the surface of the work is heated by shot blasting.

Also in the case of FIG. 4, an ultrafine crystal layer is, as illustrated, formed in a predetermined region directly under the surface, and at least a predetermined number of cracks are formed in a fine crystal layer under the ultrafine crystal layer, namely, about $20/1\mu^2$ are formed.

In the examples of FIGS. 3 and 4, the ultrafine crystal layer is formed to a depth of about 400 nm from the surface.

Figure 5:
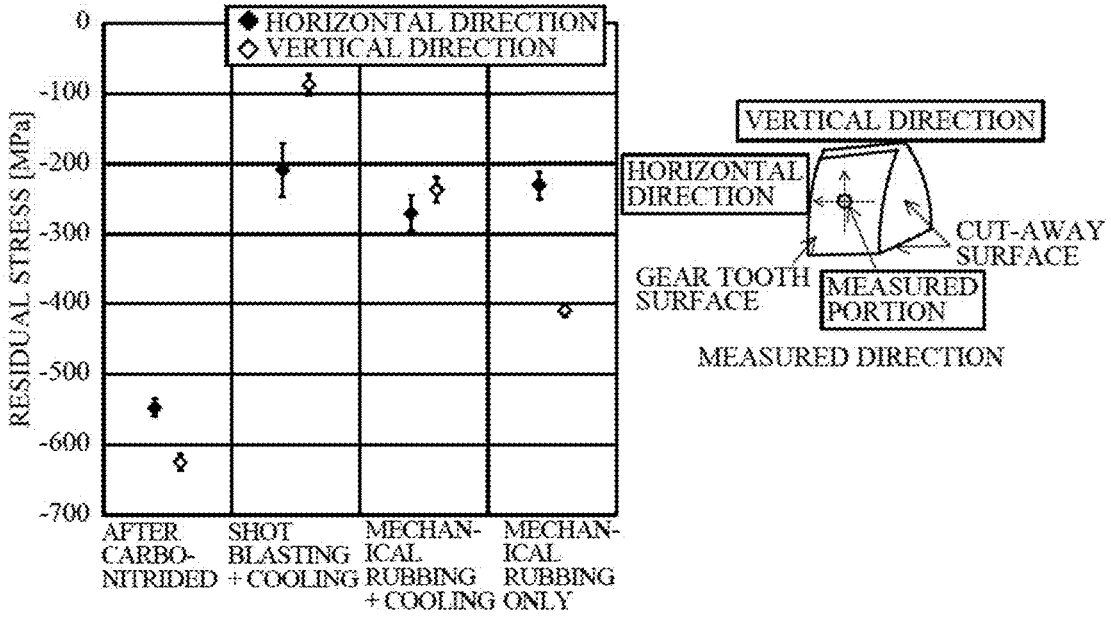
FIG. 5 is a data chart showing residual stress, measured by x-ray diffraction, immediately under a surface of a gear manufactured in accordance with the process diagram shown in FIG. 1.
Figure 6:
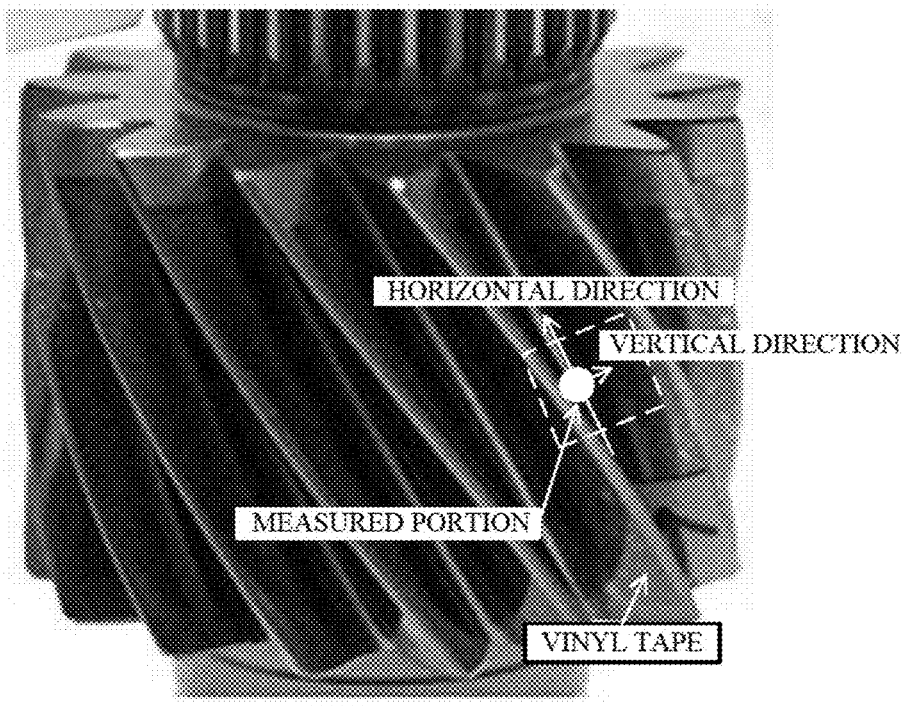
FIG. 6 is a photograph for explaining the region where the data of FIG. 5 are measured.

FIG. 5 is a data chart related to a gear 10 manufactured in accordance with the process diagram shown in FIG. 1, showing horizontal and vertical residual stress measured by x-ray diffraction in the horizontal and vertical directions of the aforesaid predetermined region immediately under a tooth surface when part of the tooth surface is cut away in the indicated direction as shown on the right side of the drawing. FIG. 6 is a photograph for explaining the region where the data of FIG. 5 were measured.

In FIG. 5 the left column shows measured values of residual stress in the predetermined region immediately after the work (gear 10) was carbonitrided (after process of S14) (FIG. 5 left column), and the columns to the right thereof each shows residual stress of the predetermined region when one of three types of processing, namely shot blasting+cooling, mechanical rubbing+cooling, or mechanical rubbing only, was performed.

As shown, shot blasting+cooling and mechanical rubbing+cooling reduced residual stress in the horizontal/vertical directions, and it can be seen that reduction in the vertical direction was especially large by shot blasting+cooling. Moreover, considerable decrease in the horizontal direction value was measured also in the case of mechanical rubbing only.

In other words, the inventor achieved this invention by discerning from the measured data of FIG. 5 that when the heating/cooling process explained with reference to the process diagram of FIG. 1 is repeated a predetermined number of times to form an ultrafine crystal layer in a predetermined region immediately under the surface of the steel material and form at least a predetermined number of cracks thereunder, residual stress of the predetermined region immediately under the surface is relieved by the indicated values, so that toughness in the predetermined region immediately under the surface is increased in proportion.

Based on the aforesaid knowledge, the inventor discovered that this enhances tenacity and suppresses crack growth in the gear (steel part) 10, whereby wear debris discharged from the predetermined region during meshing with another gear becomes fine and exfoliation and generation of large grains can be inhibited, so that performance and durability of the manufactured gear 10 is improved.

As set out above, in the steel part (gear 10) according to this embodiment, the surface of a steel material cut to a desired shape and carbonitrided is heated by excitation and thereafter repeatedly heated/cooled a predetermined number of times, such that an ultrafine crystal layer is formed immediately under the surface of the steel material (more exactly, in its predetermined region) and at least a predetermined number of cracks are formed under the formed ultrafine crystal layer (S10 to S24), by which configuration toughness of the surface or immediately thereunder can be increased, thereby enhancing tenacity and inhibiting growth of cracks. Therefore, at the time of sliding with another steel part (gear 10) during use, exfoliation and generation of large-grain wear debris can be inhibited by discharging wear debris as fine grain abrasion powder, thereby enabling enhanced performance and durability of the manufactured gear (steel part) 10.

In other words, by repeating the heating-cooling process the predetermined number of times so as to form the ultrafine crystal layer immediately under the surface of the steel material and form the cracks in at least the predetermined number thereunder, it is possible to relieve solely residual stress immediately under the surface without lowering residual stress of the entire steel part, whereby toughness of the surface can be increased and tenacity improved.

As a result, exfoliation and occurrence of large grain wear debris immediately under the surface during sliding with another steel part can be inhibited to realize improved performance and durability of the gear (steel part) 10.

Moreover, the steel part (gear 10) manufacturing method for manufacturing a steel part from a steel material comprises a cutting step for cutting the steel material to machine it to a desired shape (S10), a carbonitriding step for carbonitriding the cut steel material (S14), and crack forming steps for exciting and heating a surface of the carbonitrided steel material and thereafter repeatedly performing heating/cooling that cools a predetermined number of times (Cref), thereby forming an ultrafine crystal layer immediately under the surface of the steel material (more exactly, in a predetermined region thereof), and forming at least a predetermined number of cracks under the formed ultrafine crystal layer (in a fine crystal layer) (S18 to S24), by which configuration, as stated above, toughness of the surface or immediately thereunder can be increased, thereby enhancing tenacity and inhibiting growth of cracks. Therefore, at the time of sliding with another steel part during use, exfoliation and generation of large-grain wear debris can be inhibited by discharging wear debris as fine grain abrasion powder, thereby enabling enhanced performance and durability of the manufactured gear (steel part) 10.

In other words, by repeating the heating-cooling process the predetermined number of times so as to form the ultrafine crystal layer immediately under the surface of the steel material and form the cracks in at least the predetermined number thereunder, it is possible to relieve solely residual stress immediately under the surface without lowering residual stress of the entire steel part, whereby toughness of the surface can be increased and tenacity improved.

As a result, exfoliation and occurrence of large grain wear debris immediately under the surface during sliding with another steel part can be inhibited to realize improved performance and durability of the manufactured gear (steel part) 10.

Moreover, since the heating-cooling of the crack forming process (S18 to S20) is configured to include a step to mechanically rub the surface of the steel material to heat and then cool the heated surface of the steel material, there can be obtained, in addition to the effects mentioned above, it becomes easy to perform the steel material surface heating by excitation.

Further, since the heating-cooling of the crack forming process (S18 to S20) is configured to include the step of bringing particles or fluid into collision with the steel material surface (by, for example, shot blasting, shot peening, thermal spraying or the like) to heat and then cool the heated surface of the steel material, there can be obtained, in addition to the effects mentioned above, it becomes easy to perform the steel material surface heating by excitation.

Although the steel part is exemplified by a vehicle automatic transmission gear in the foregoing, this is nut a limitation and the steel part can be of any type.

INDUSTRIAL APPLICABILITY

According to this invention, a surface of a steel material cut to a desired shape and carbonitrided is heated by excitation and thereafter repeatedly heated/cooled a predetermined number of times, such that an ultrafine crystal layer is formed immediately under the surface of the steel material and at least a predetermined number of cracks are formed under the formed ultrafine crystal layer, thereby enabling to increase toughness of the surface or immediately thereunder and enhance tenacity and inhibiting growth of cracks.

DESCRIPTION OF SYMBOLS

10 Gear (Steel part)

The invention claimed is:

1. A steel part, comprising:

a steel material cut to a desired shape and carbonitrided, whose surface is then repeatedly heated by excitation and cooled a predetermined number of times, such that an ultrafine crystal layer is formed immediately under the surface of the steel material and at least a predetermined number of cracks are formed under the formed ultrafine crystal layer.

2. A method for manufacturing a steel part from a steel material, comprising:

a cutting step to cut the steel material to machine the material to a desired shape;

a carbonitriding step to carbonitride the cut and machined steel material; and a crack forming step to excite and heat a surface of the carbonitrided steel material and thereafter cools, and repeat the heating and cooling a predetermined number of times, thereby forming an ultrafine crystal layer immediately tinder the surface of the steel material, and forming at least a predetermined number of cracks under the formed ultrafine crystal layer.

3. The method according to claim 2, wherein the crack forming step comprises:

a step to mechanically rub the surface of the steel material to heat and then cool the heated surface of the steel material.

4. The method according to claim 2, wherein the crack forming step comprises:

a step to bring particles or fluid into collision with the surface of the steel material to heat and then cool the heated surface of the steel material.

* * * * *